US011267249B2

(12) United States Patent
Hase et al.

(10) Patent No.: US 11,267,249 B2
(45) Date of Patent: Mar. 8, 2022

(54) WIPING DEVICE, HEAD MAINTENANCE DEVICE, AND LIQUID DISCHARGE APPARATUS

(71) Applicant: Ricoh Company, Ltd., Tokyo (JP)

(72) Inventors: Takayuki Hase, Kanagawa (JP); Taku Hatakeyama, Kanagawa (JP); Takashi Watanabe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/119,299

(22) Filed: Dec. 11, 2020

(65) Prior Publication Data

US 2021/0187952 A1 Jun. 24, 2021

(30) Foreign Application Priority Data

Dec. 23, 2019 (JP) ..... JP2019-231639

(51) Int. Cl.
*B41J 2/165* (2006.01)

(52) U.S. Cl.
CPC ..... *B41J 2/16544* (2013.01); *B41J 2/16535* (2013.01); *B41J 2002/1655* (2013.01); *B41J 2002/16558* (2013.01)

(58) Field of Classification Search
CPC ..... B41J 2/16544; B41J 2/16535; B41J 2002/1655; B41J 2002/16558
See application file for complete search history.

(56) References Cited

U.S. PATENT DOCUMENTS

| | | | | |
|---|---|---|---|---|
| 8,342,638 | B2 * | 1/2013 | Sole Pons | B41J 2/16552 347/33 |
| 2019/0275805 | A1 | 9/2019 | Watanabe et al. | |
| 2019/0275811 | A1 | 9/2019 | Hatakeyama et al. | |
| 2019/0275818 | A1 | 9/2019 | Watanabe et al. | |
| 2019/0283460 | A1 | 9/2019 | Hatakeyama et al. | |

FOREIGN PATENT DOCUMENTS

| | | |
|---|---|---|
| JP | 2010-234666 | 10/2010 |
| JP | 2010-234667 | 10/2010 |
| JP | 2010-234668 | 10/2010 |
| JP | 2011-025621 | 2/2011 |
| JP | 2011-251420 | 12/2011 |
| JP | 2013-180440 | 9/2013 |

* cited by examiner

*Primary Examiner* — Geoffrey S Mruk
(74) *Attorney, Agent, or Firm* — Xsensus LLP

(57) ABSTRACT

A wiping device includes a first web material, a second web material, and a pressing member. The second web material is different from the first web material. The pressing member presses the first web material and the second web material to a target to be wiped. The first web material and the second web material are overlaid on top of one another and pressed against the target to be wiped.

7 Claims, 7 Drawing Sheets

WIPING DEVICE, HEAD MAINTENANCE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2019-231639, filed on Dec. 23, 2019, in the Japan Patent Office, the entire disclosure of which is incorporated by reference herein.

BACKGROUND

Technical Field

Aspects of the present disclosure relate to a wiping device, a head maintenance device, and a liquid discharge apparatus.

Related Art

Generally, an apparatus using a liquid discharge head includes a maintenance-and-recovery device (head maintenance device) including, e g, a cap to cap a nozzle surface of the liquid discharge head and a wiping device to wipe the nozzle surface of the liquid discharge head to perform an operation for maintaining and recovering a condition of the nozzle surface.

SUMMARY

In an aspect of the present disclosure, there is provided a wiping device that includes a first web material, a second web material, and a pressing member. The second web material is different from the first web material. The pressing member presses the first web material and the second web material to a target to be wiped. The first web material and the second web material are overlaid on top of one another and pressed against the target to be wiped.

In another aspect of the present disclosure, there is provided a head maintenance device that includes the wiping device to wipe a liquid discharge head.

In still another aspect of the present disclosure, there is provided a liquid discharge apparatus that includes the liquid discharge head to discharge a liquid and the head maintenance device.

In still yet another aspect of the present disclosure, there is provided a liquid discharge apparatus that includes a liquid discharge head to discharge a liquid and the wiping device to wipe the liquid discharge head.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
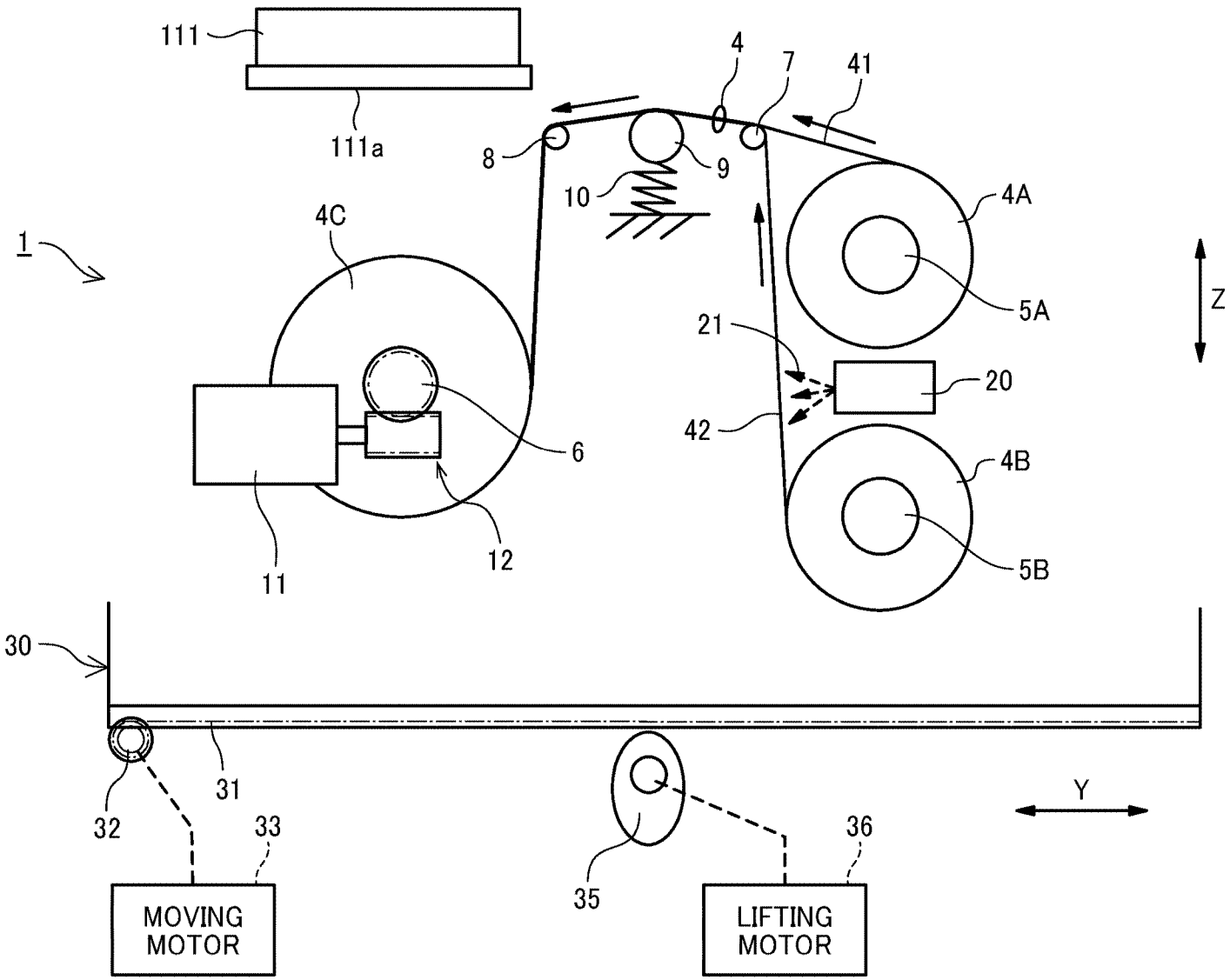
FIG. 1 is a side view of a wiping device in a home position, according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
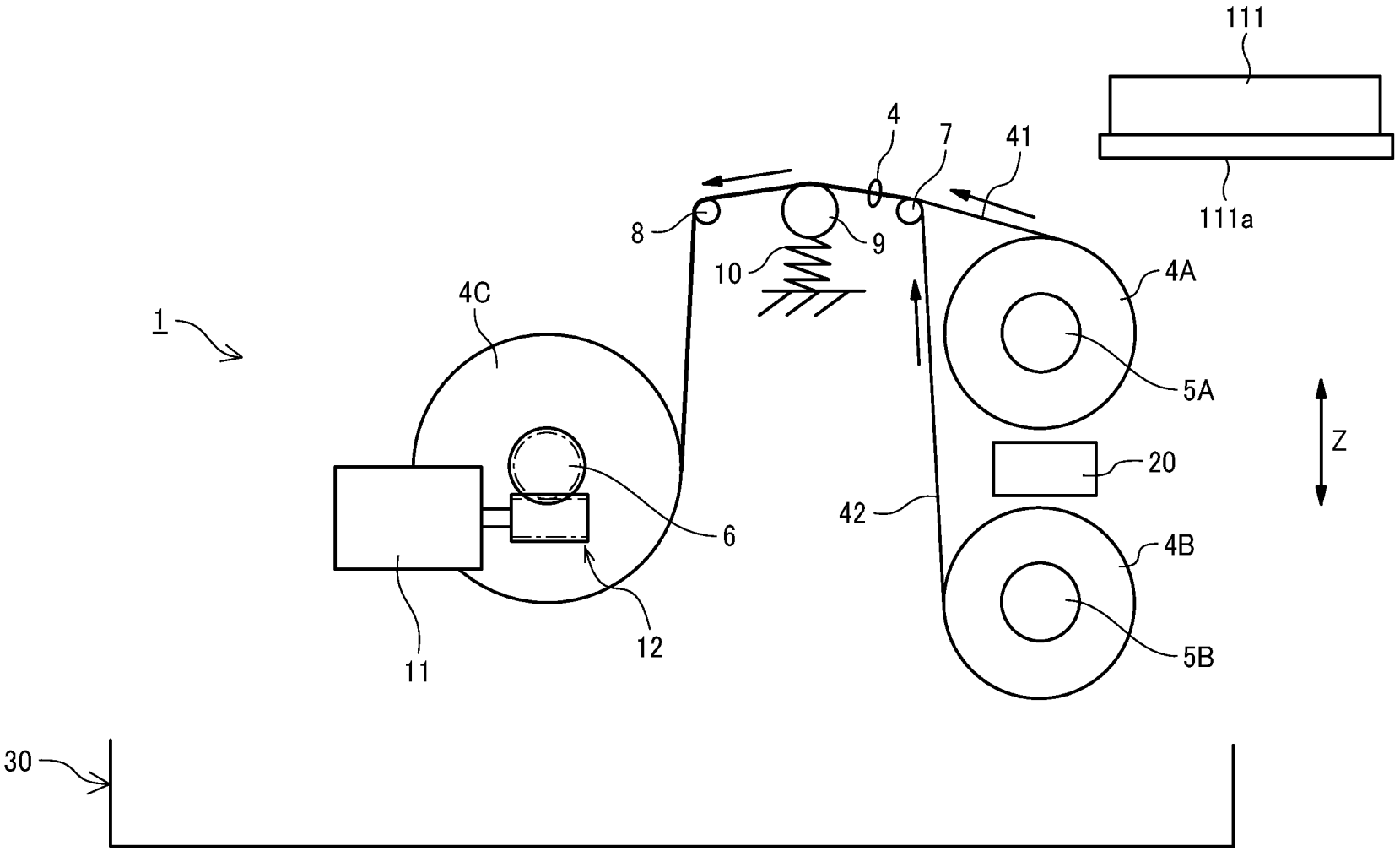
FIG. 2 is another side view of the wiping device of FIG. 1 when a wiping operation ends.
Figure 3:
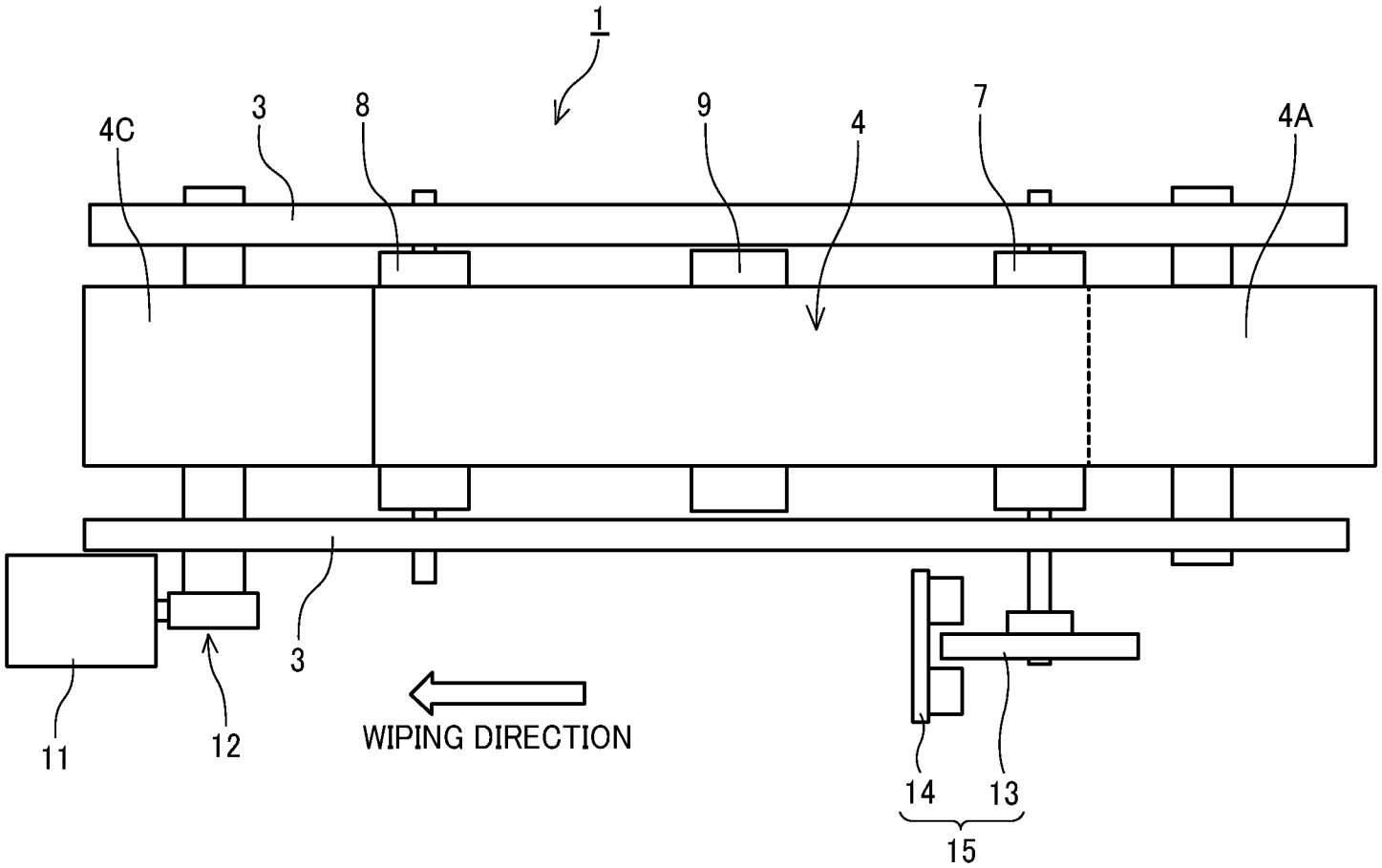
FIG. 3 is a plan view of the wiping device of FIG. 1.

A first embodiment of the present disclosure is described with reference to FIGS. 1 to 3. FIG. 1 is a side view of a wiping device 1 according to the present embodiment. FIG. 2 is another side view of the wiping device 1 when a wiping operation ends, according to the present embodiment. FIG. 3 is a plan view of the wiping device 1 according to the present embodiment.

Figure 6:
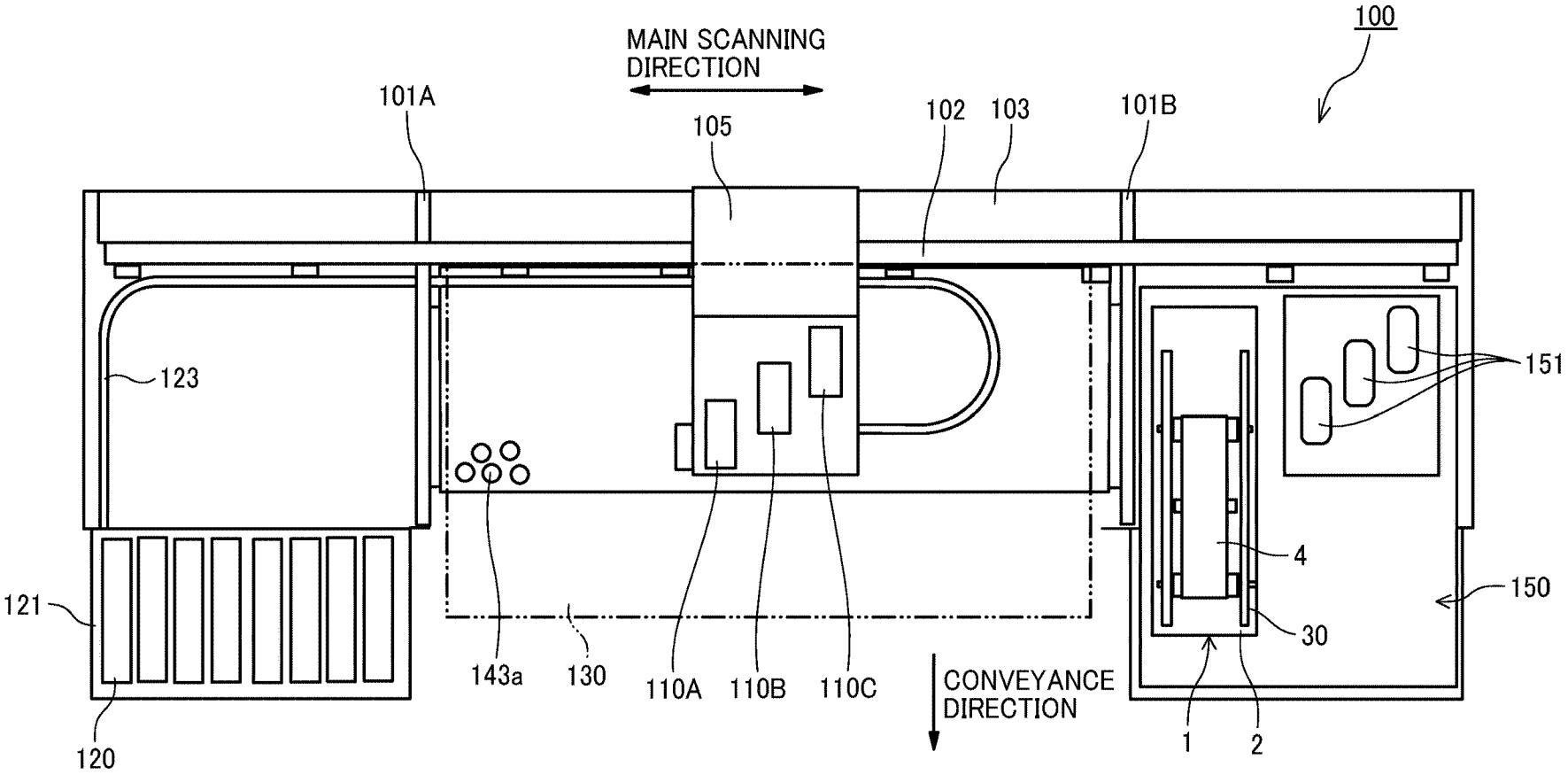
FIG. 6 is a plan view of a mechanical section of a liquid discharge apparatus according to an embodiment of the present disclosure.

In the present embodiment, the wiping target that is wiped off by the wiping device 1 is a nozzle surface 111*a* of a liquid discharge head 111 of a liquid discharge apparatus 100 (see FIG. 6). Note that the liquid discharge head 111 may be referred to simply as the head 111 in the following description.

The wiping device 1 has a wiping unit 30 that is held on a main frame of the liquid discharge apparatus 100, which is held on a main body of the liquid discharge apparatus 100 upon adjustment, in such a manner that the wiping unit 30 can reciprocate in a wiping direction indicated by arrow Y in FIG. 1.

The wiping unit 30 includes a pair of side plates 3, and a feed roller 5A that serves as the shaft of a roll 4A, which is formed by rolling a first web material 41 around the feed roller 5A, and a feed roller 5B that serves as the shaft of a roll 4B, which is formed by rolling a second web material 42 around the feed roller 5B, are provided between the pair of side plates 3.

Figure 5:
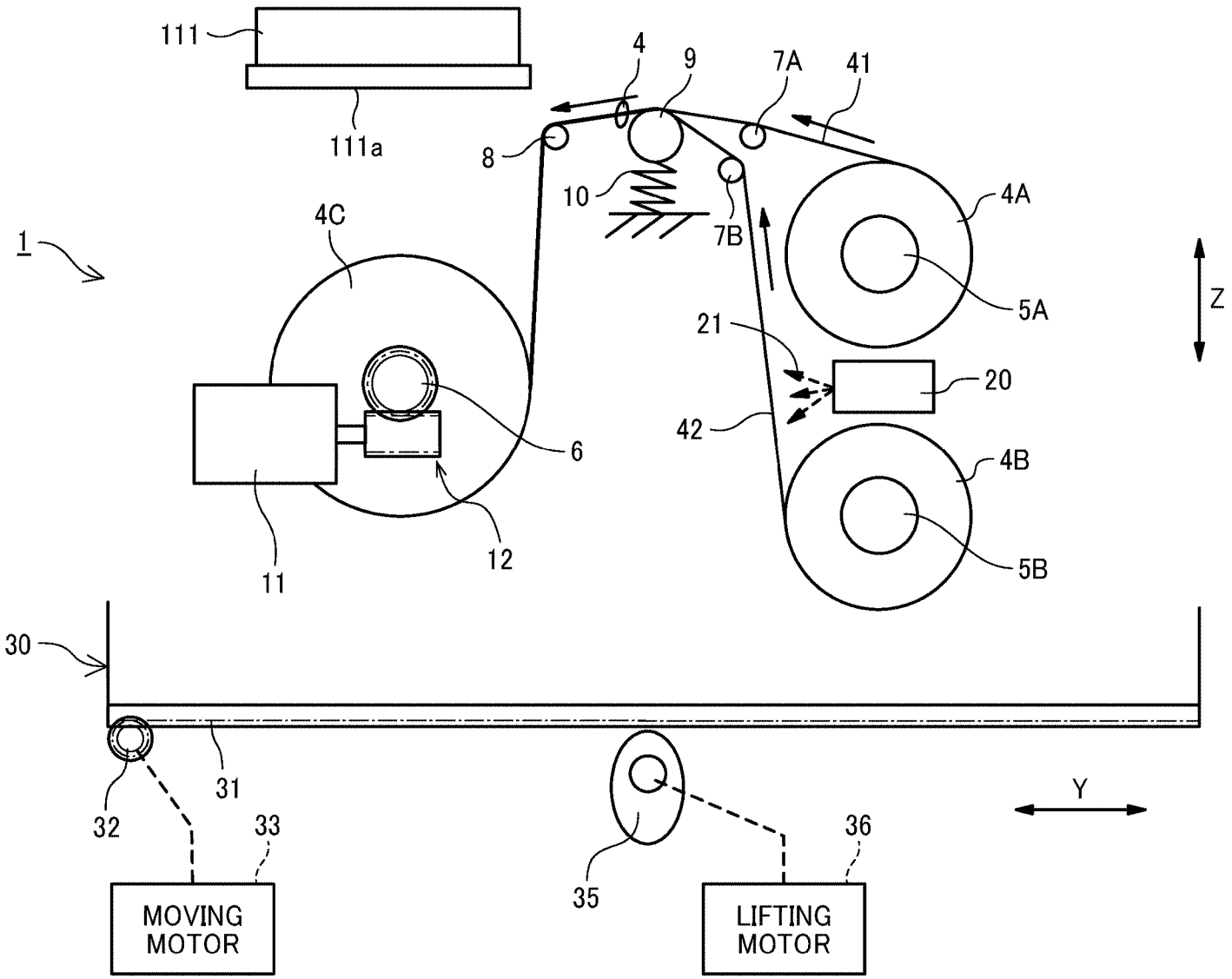
FIG. 5 is a side view of the wiping device in a home position, according to a second embodiment of the present disclosure.

The feed directions of the first web material 41 and the second web material 42 are directions indicated by arrows in FIGS. 1, 2, and 5.

Further, between the side plates 3, there is provided a winding roller 6 that is an axial member of a winding roll 4C. The winding roll 4C winds the wiping member 4 including the first web material 41 and the second web material 42, which are overlaid on top of one another and conveyed from the rolls 4A and 4B.

The feeding direction of the wiping member 4 is a direction of an arrow in each of FIGS. 1, 2, and 5.

Further, between the side plates 3, there is provided a winding roller 6 which is an axial member of a winding roll 4C. The winding roll 4C winds the wiping member 4 including the first web material 41 and the second web material 42, which are overlaid on top of one another and conveyed from the rolls 4A and 4B.

The feeding direction of the wiping member 4 is in the direction of the arrows in FIGS. 1, 2, and 5.

The first web material 41 is a member whose surface is in contact with the nozzle surface 111*a* of the head 111 to be wiped, and the second web material 42 is a member arranged on the back face of the first web material 41.

The first web material 41 and the second web material 42 are members having different properties. For example, the first web material 41 is made of a material that can be wiped strongly, and the second web material 42 is made of a material that easily contains a cleaning liquid.

A pair of guide rollers 7 and 8 are rotatably held on the pair of side plates 3 of the wiping unit 30. Between the guide rollers 7 and 8, a pressing member (pressure member) 9 is disposed to press the wiping member 4 onto the nozzle surface 111*a* that serves as a target to be wiped.

The pressing member 9 presses the wiping member 4 against the surface of the nozzle surface 111*a* with a predetermined pressing force by the spring 10 when the wiping operation is performed.

The driving force of the winding motor 11 is transmitted to the winding roller 6 via a transmission mechanism 12 including a gear train.

A code wheel 13 is attached to the guide roller 7, and an encoder sensor 14 including a transmissive photosensor that detects a pattern formed on the code wheel 13 is disposed.

An encoder 15 that detects the moving distance (feed amount) of the wiping member 4 includes the code wheel 13 and the encoder sensor 14.

The pair of side plates 3, as well as the first web material 41, the second web material 42, the feed rollers 5A and 5B, the winding roller 6, the guide rollers 7 and 8, and the pressing member 9, which are held between the side plates 3, are unitized as a wiping unit (cartridge) 30 and detachably mounted on a main body of the wiping device 1.

The wiping unit 30 is arranged so as to be reciprocatingly movable in the wiping direction indicated by arrow Yin FIG. 1, which is a nozzle arrangement direction of the head 111 in which nozzles are arranged in row. The reciprocating movement of the wiping unit 30 can be performed by, for example, a moving mechanism including a rack 31, a pinion 32, and a moving motor 33 for rotating the pinion 32, or a moving mechanism including a timing belt and a pulley.

The wiping unit 30 is disposed to be movable in directions indicated by arrow Z in FIG. 1 in which the wiping member 4 advances and retreats with respect to the nozzle surface 111*a*, in this case, movable (liftable) upward and downward in the vertical direction. Lifting of the wiping unit 30, for example, can be performed by a lifting mechanism including a cam 35 and a lifting motor 36 for rotating the cam 35, a lifting mechanism including rack and pinion, and so forth. At this time, the reciprocating movement mechanism of the wiping unit 30 moves in the vertical direction.

Further, a cleaning liquid nozzle 20, for applying cleaning liquid 21 to the second web material 42, is disposed. The cleaning liquid is supplied to the cleaning liquid nozzle 20 from the apparatus main body side.

Figure 4:
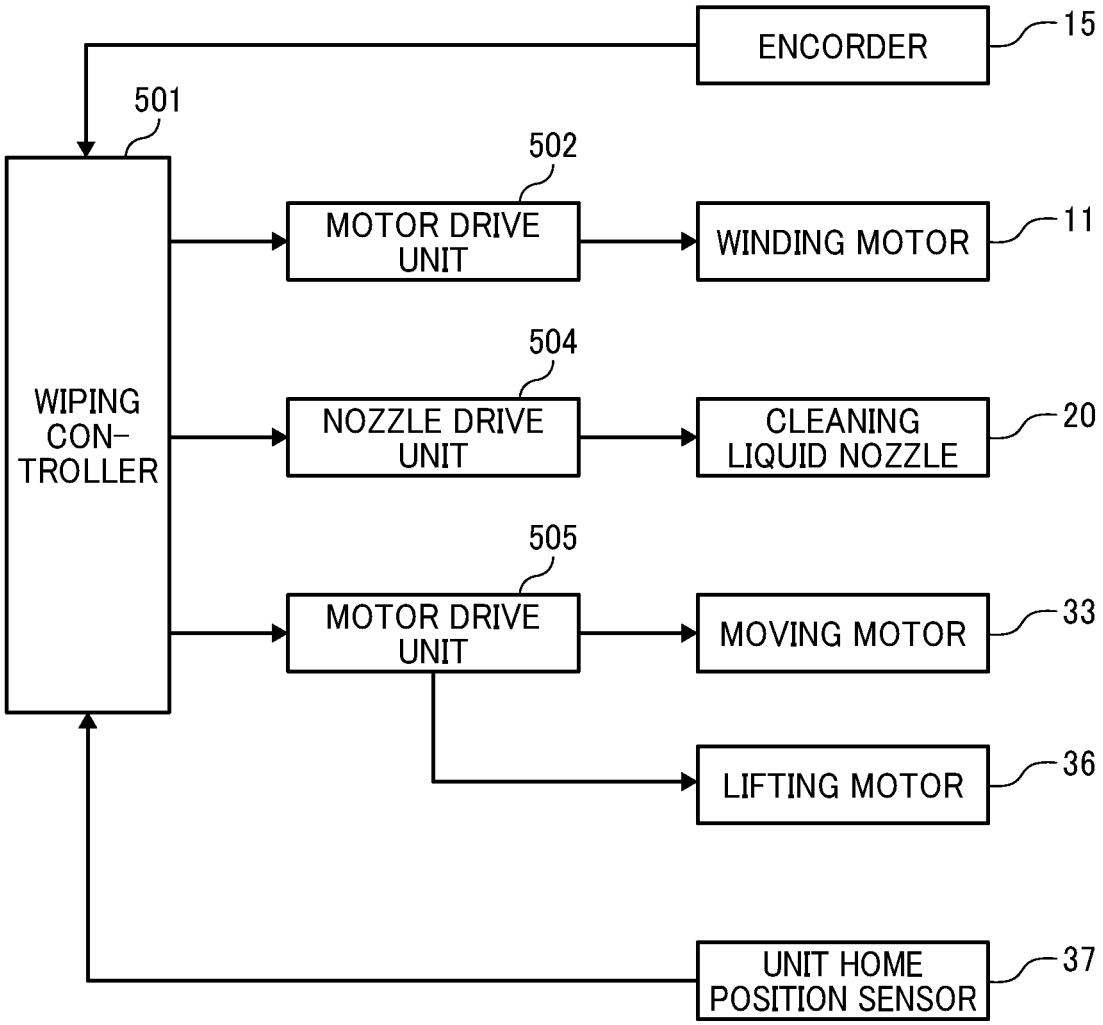
FIG. 4 is a block diagram illustrating elements of the wiping device of FIG. 1 that control a wiping operation.

FIG. 4 is a block diagram illustrating elements of the wiping device 1 that control the wiping operation, according to the present embodiment.

The wiping control unit 501 is a controller to controls the wiping device 1, and can be configured as, for example, a part of a control unit of the liquid discharge apparatus 100 on which the wiping device 1 is mounted.

The wiping control unit 501 drives and controls the winding motor 11 to drive and rotate the winding roller 6 via a motor drive unit 502. In this case, the wiping control unit 501 counts the output pulse of the encoder 15, detects the winding amount of the wiping member 4, and drives the winding motor 11.

The wiping control unit 501 drives the cleaning liquid nozzle 20 via a nozzle drive unit 504, and controls the application (supply) of the cleaning liquid 21 to the second web material 42.

The wiping control unit 501 drives and controls the moving motor 33 and the elevating motor 36 via the motor drive unit 505, and controls the lifting of the wiping unit 30 to the wiping position and the relative movement of the wiping unit 30 in the wiping direction with respect to the nozzle surface 111*a*.

Thus, the first web material 41 and the second web material 42, which are fed out from the rolls 4A and 4B and are conveyed, are overlaid on top of one another and conveyed by the guide roller 7 on the upstream side from the pressing member 9 in a conveyance direction of the first web material 41 and the second web material 42.

Then, the first web material 41 and the second web material 42 are pressed against the nozzle surface 111*a* of the head 111 by the pressing member 9 in an overlaid state in which the first web material 41 and the second web material 42 are overlaid on top of one another. At this time, for example, the first web material 41, which has a relatively high wiping property, and the second web material 42, which has a relatively high liquid holding capacity, can be pressed against the nozzle surface 111*a* in the overlaid state.

Thus, with a simple configuration, the desired wiping performance can be provided to the wiping member 4, thereby enhancing the wiping performance as the wiping member.

In this case, there is no need to create a composite member consisting of the first web material 41 and the second web material 42 having different properties, and the desired wiping performance can be obtained at a low cost. Further, the first web material 41 and the second web material 42, which is difficult to be laminated together, can be combined, and the range of combinations of the wiping member 4 is widened.

A second embodiment of the present disclosure is described below with reference to FIG. 5. FIG. 5 is a side view of the wiping device 1 in a home position, according to the second embodiment of the present disclosure.

In the present embodiment, the first web material 41 and the second web material 42 are overlaid on top of one another on the pressing member 9 and conveyed. In the present embodiment, the first web material 41 is guided by a guide roller 7A, and the second web material 42 is guided by a guide roller 7B. However, no limitation is indicated thereby. For example, the second web material 42 can be introduced directly into the pressing member 9.

Even with such a configuration described above, the same effects as in the first embodiment can be obtained.

In each of the above-described embodiments, the example of two different overlaid web materials is described. However, three or more different web materials can also be overlaid on top of one another.

Figure 7:
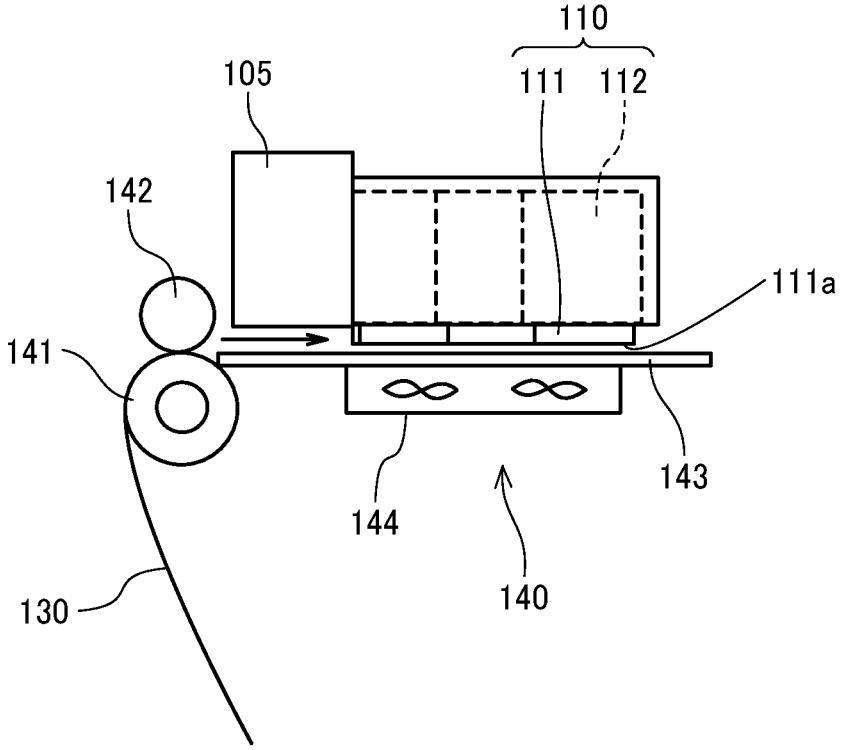
FIG. 7 is a side view of a principal mechanism of the liquid discharge apparatus of FIG. 6.

A liquid discharge apparatus 100 according to an embodiment of the present disclosure is described with reference to FIGS. 6 and 7. FIG. 6 is a plan view of the mechanical section of the liquid discharge apparatus 100 according to the present embodiment. FIG. 7 is a side view of a principal mechanism of the liquid discharge apparatus 100 according to the present embodiment.

The liquid discharge apparatus 100 is a serial type device. A carriage 105 is movably held in the main scanning direction by a guide mechanism such as a main guide member 102 and a secondary guide plate 103, which are laid across a pair of right and left side plates 101B and 101A.

The carriage 105 has three liquid discharge units 110 (110A, 110B, and 110C in FIG. 6). Each of the liquid discharge units 110 is configured by integrating a liquid discharge head 111 as a liquid discharger and a sub-tank 112 that supplies liquid to the head 111.

A cartridge holder 121 is disposed on the main body of the liquid discharge apparatus 100, and a plurality of main tanks (liquid cartridges) 120 that contains liquids of different colors are replaceably mounted on the cartridge holder 121. Liquid of each color is supplied from the main tank 120 mounted on the cartridge holder 121 to the head 111 of each liquid discharge unit 110 by, e.g., a liquid feed pump via a liquid path 123 configured with a supply tube of each color.

Moreover, the liquid discharge apparatus 100 includes a conveyor 140 to convey a sheet material 130 in a conveyance direction. The conveyor 140 attracts and conveys the sheet material 130 such that the sheet material 130 faces the head 111 while the sheet material 130 is being conveyed.

The conveyor 140 includes a conveying roller 141, a pressure roller 142 pressed against and in contact with the conveying roller 141, a platen member 143 facing the head 111, a suction mechanism that suctions air via suction holes 143*a* (see FIG. 6) of the platen member 143 to attract the sheet material 130 onto the conveyor 140, and so forth. Although partially illustrated in the FIG. 6, the suction holes 143*a* are arranged on the entire platen member 143.

Further, a maintenance-and-recovery mechanism 150 that performs maintenance-and-recovery (maintenance) of the heads 111 is disposed on one side of the carriage 105 in the main scanning direction.

The maintenance-and-recovery mechanism 150 is a head maintenance device according to an embodiment of the present disclosure, and includes, for example, caps 151 to cap the nozzle surfaces 111*a* of the heads 111 and a wiping unit 30 according to an embodiment of the present disclosure to wipe the nozzle surfaces 111*a*. The wiping unit 30 is disposed on a main frame 2.

In the liquid discharge apparatus 100, the sheet material 130 is conveyed in the conveyance direction by the conveying roller 141 and the pressure roller 142, while being attracted on the platen member 143.

Then, the carriage 105 is moved in the main scanning direction and the head 111 is driven in response to a print signal. By so doing, the liquid of desired color is discharged onto the stopped sheet material 130 to print one line. After the sheet material 130 is fed by a predetermined amount, printing of the next line is performed. This set of processes are repeated to complete the printing, and the sheet material 130 is ejected.

In the embodiments of the present disclosure, the liquid to be discharged is not limited to a particular liquid provided that the liquid has a viscosity or surface tension dischargeable from a head. However, preferably, the viscosity of the liquid is not greater than 30 millipascal-second (mPa·s) under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as deoxyribonucleic acid (DNA), amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The liquid discharge unit used herein is an integrated unit including a liquid discharge head, a functional part, and mechanisms, and may be an assembly of parts relating to liquid discharge. For example, the liquid discharge unit may be a combination of the liquid discharge head with at least one of a head tank, a carriage, a supply mechanism, a maintenance-and-recovery mechanism, and a main scanning moving mechanism.

The integrated unit may also be a combination in which the liquid discharge head, the functional part, and the mechanisms are secured to one another through, e.g., fastening, bonding, or engaging, or a combination in which one of the liquid discharge head, the functional part, and the mechanisms is movably held by another. The liquid discharge head, the functional part, and the mechanisms may also be detachably attached to one another.

For example, the liquid discharge unit may include the liquid discharge head and the head tank that are integrated as a single unit. Alternatively, the liquid discharge head and the head tank may be connected with a tube and integrated as a single unit. A unit including a filter may further be added to a portion between the head tank and the liquid discharge head of the liquid discharge unit.

In another example, the liquid discharge unit may include the liquid discharge head and the carriage that are integrated as a single unit.

In still another example, the liquid discharge head is held on a guide member that forms part of the main scanning moving mechanism, and the liquid discharge unit may include the liquid discharge head and the main scanning moving mechanism that are integrated as a single unit. In still another example, the liquid discharge unit may include the liquid discharge head, the carriage, and the main scanning moving mechanism that are integrated as a single unit.

In still another example, a cap that forms part of the maintenance-and-recovery mechanism is secured to the carriage mounted the liquid discharge head, the liquid discharge unit may include the liquid discharge head and the maintenance-and-recovery mechanism that are integrated as a single unit.

In still another example, tubes are connected to the head tank or a channel member mounted on the liquid discharge head, the liquid discharge unit may include the liquid discharge head and the supply mechanism that are integrated as a single unit. Through the tubes, liquid of a liquid storage source such as an ink cartridge is supplied to the liquid discharge head.

Examples of the main scanning moving mechanism include a single guide member. The supply mechanism may be a tube only or a loading unit alone.

The term "liquid discharge apparatus" used herein also represents an apparatus including the liquid discharge head or the liquid discharge unit that drives the liquid discharge head to discharge liquid. The liquid discharge apparatus may be, for example, an apparatus capable of discharging liquid to a material to which liquid can adhere and an apparatus to discharge liquid toward gas or into liquid.

The liquid discharge apparatus may include at least one of devices for feeding, conveying, and ejecting a material to which liquid is adherable. The liquid discharge apparatus may further include at least one of a pre-processing device and a post-processing device.

Specific examples of the liquid discharge apparatus include, but are not limited to, an image forming apparatus that discharges ink to form an image on a sheet and a three-dimensional apparatus that discharges a molding liquid to layered powder to form a three-dimensional object.

The liquid discharge apparatus is not limited to a device that discharges liquid to visualize meaningful images such as letters or figures. For example, the liquid discharge apparatus may be a device that forms meaningless images such as meaningless patterns or an apparatus that fabricates three-dimensional images.

The above-described term "material onto which liquid can adhere" represents a material on which liquid is at least temporarily adhered, a material on which liquid is adhered and fixed, or a material into which liquid is adhered to permeate. Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell. The "material onto which liquid can adhere" includes any material onto which liquid adheres, unless particularly limited.

Examples of the "material onto which liquid can adhere" include any materials on which liquid can adhere even temporarily, such as paper, thread, fiber, fabric, leather, metal, plastic, glass, wood, and ceramic.

The liquid discharge apparatus may be a device that relatively moves a liquid discharge head and a material to which liquid is adherable. However, the liquid discharge apparatus is not limited to such a device. The liquid discharge apparatus 100 may be, for example, a serial-type apparatus to move the liquid discharge head relative to a sheet material or a line-type apparatus that does not move a liquid discharge head relative to a sheet material.

Examples of the liquid discharge apparatus further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" are herein used as synonyms.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A wiping device comprising:

a first web material;

a second web material different from the first web material; and a presser configured to press the first web material and the second web material to a target to be wiped, a first feed roller and a second feed roller, wherein the first web material and the second web material are fed out from the first feed roller and the second feed roller respectively, conveyed separately, and overlaid on top of one another and pressed against the target to be wiped by the presser.

2. The wiping device according to claim 1, wherein the first web material and the second web material are overlaid on top of one another on an upstream side from the presser in a direction in which the first web material and the second web material are conveyed.

3. The wiping device according to claim 1, wherein the first web material and the second web material are overlaid on top of one another on the presser.

4. The wiping device according to claim 1, wherein the target to be wiped is wiped as the target to be wiped is moved relative to the first web material and the second web material that are overlaid on top of one another.

5. A head maintenance device, comprising the wiping device according to claim 1 configured to wipe a liquid discharge head.

6. A liquid discharge apparatus comprising:

a liquid discharge head configured to discharge a liquid; and the head maintenance device according to claim 5 configured to wipe the liquid discharge head.

7. A liquid discharge apparatus comprising:

a liquid discharge head configured to discharge a liquid; and the wiping device according to claim 1 configured to wipe the liquid discharge head.

* * * * *